United States Patent [19]

Yerman

[11] Patent Number: 4,892,366

[45] Date of Patent: Jan. 9, 1990

[54] SNEEZE GUARD SYSTEM

[75] Inventor: Donald Yerman, Euclid, Ohio

[73] Assignee: Crescent Metal Products, Inc., Cleveland, Ohio

[21] Appl. No.: 352,648

[22] Filed: May 12, 1989

Related U.S. Application Data

[63] Continuation of Ser. No. 658,810, Oct. 9, 1984, abandoned.

[51] Int. Cl.[4] ..... A47B 96/18

[52] U.S. Cl. ..... 312/140.4; 108/152

[58] Field of Search ..... 312/277, 140.4; 108/32, 108/134, 152; 248/444.1, 445; 186/44

[56] References Cited

U.S. PATENT DOCUMENTS

| | | | |
|---|---|---|---|
| 542,318 | 7/1895 | Sjoholm | 108/152 |
| 3,026,162 | 3/1962 | Waszkiewicz | 312/140.4 |
| 3,033,627 | 5/1962 | Brown et al. | 108/152 |
| 4,013,880 | 3/1977 | Kennedy, Jr. et al. | 312/140.4 |
| 4,313,589 | 2/1982 | Vega | 248/444.1 |

FOREIGN PATENT DOCUMENTS

| | | | |
|---|---|---|---|
| 216699 | 1/1961 | Austria | 108/152 |

*Primary Examiner*—Joseph Falk

*Attorney, Agent, or Firm*—Renner, Otto, Boisselle & Sklar

[57] ABSTRACT

A sneeze guard system comprising a sneeze guard panel having oppositely bent top and bottom edge portions, support legs for supporting the sneeze guard panel in a supported position, and a channel member secured between the top ends of the support legs for mounting the sneeze guard panel on the support legs in such supported position while permitting removal of the sneeze guard panel upon relative pivoting to a release position. The channel member defines with the support legs respective slots sized to permit passage of the top edge portion of the sneeze guard panel into said channel member when in such released position and then pivoting of the top edge portion to a position precluding withdrawal from the channel member when the sneeze guard panel is in its supported position atop the support legs.

14 Claims, 1 Drawing Sheet

SNEEZE GUARD SYSTEM

This is a continuation of Ser. No. 658,810, filed 10/9/84, now abandoned.

DISCLOSURE

The invention herein disclosed relates generally to sneeze guard systems for hygienic protection of food displays and, more particularly, to a sneeze guard system including a sneeze guard panel that can be easily and quickly removed for cleaning, transport, storage, etc., from a support therefor.

BACKGROUND

Sneeze guard systems heretofore have been used in restaurants, supermarkets, bakery shops, cafeterias, etc., in conjunction with food displays or settings such as serving counters, buffets, smorgasbords or the like. Such systems offer sanitary protection of the set-out food by safeguarding against contamination from airborne bacteria while permitting viewing and oftentimes access to the food display. Typically, such systems include one or more clear plastic or glass sneeze guard panels. In some systems, the sneeze guard panels are suspended as by chains from the ceiling or an overhead support, whereas in other systems panels are supported above the display by table stands, brackets, framing, etc.

For cleaning, replacement, storage, transport, etc., the sneeze guard panels in some systems desirably are detachable from their supports. Heretofore, screws, bolts and nuts, clips and other hardware items have been employed to provide for detachable securement of the panels to the supports. The use of such hardware items, however, required in many instances additional fabricating steps such as drilling of holes in the panels and/or supports for the securing fasteners. Also, the need to remove and reinstall plural fasteners took time and in some cases rendered attachment and removal of the panels particularly difficult especially in view of the large and awkward to hold panels in some systems. As other undesirable traits, the hardware items often were subject to loss or misplacement and, in an overall aesthetic design sense, often included only as a matter of necessity.

SUMMARY OF THE INVENTION

The present invention provides a novel and advantageous sneeze guard system having a unique mounting arrangement for detachable securement of a sneeze guard panel to a support therefor in both a quick and easy manner without having to install or remove screws, bolts, clips or other hardware items. Detachment of the sneeze guard panel from the support is effected by simply pivoting the sneeze guard panel relative to the support from a supported position to a release position permitting removal of the sneeze guard panel. Attachment of the sneeze guard panel to the support is just as easily accomplished in reverse manner.

Briefly, a sneeze guard system according to the invention comprises a sneeze guard panel, support means for supporting the sneeze guard panel in a supported position, and means for mounting the sneeze guard panel on the support means in such supported position while permitting removal of the sneeze guard panel upon relative pivoting to a release position.

More particularly, a sneeze guard system according to the invention comprises a sneeze guard panel having a top edge portion inclined to an adjacent major portion thereof, a pair of support legs having coplanar panel support portions for supporting the sneeze guard panel at its major portion in a supported position, and a channel member secured between the top ends of the support legs and defining therewith slots opening to the interior of the channel member which are sized to permit passage of the top edge portion of the sneeze guard panel when aligned substantially parallel to the support portions of the support legs and then pivoting of the top edge portion of the panel within the channel member to an interfering position precluding withdrawal of the top edge portion through the slots when the sneeze guard panel is in its supported position atop the support legs.

To the accomplishment of the foregoing and related ends, the invention, then, comprises the features hereinafter fully described and particularly pointed out in the claims, the following description and the annexed drawing setting forth in detail a certain illustrative embodiment of the invention, this being indicative, however, of but one of the various ways in which the principles of the invention may be employed.

DETAILED DESCRIPTION

Figures 1, 2, 3, 4:
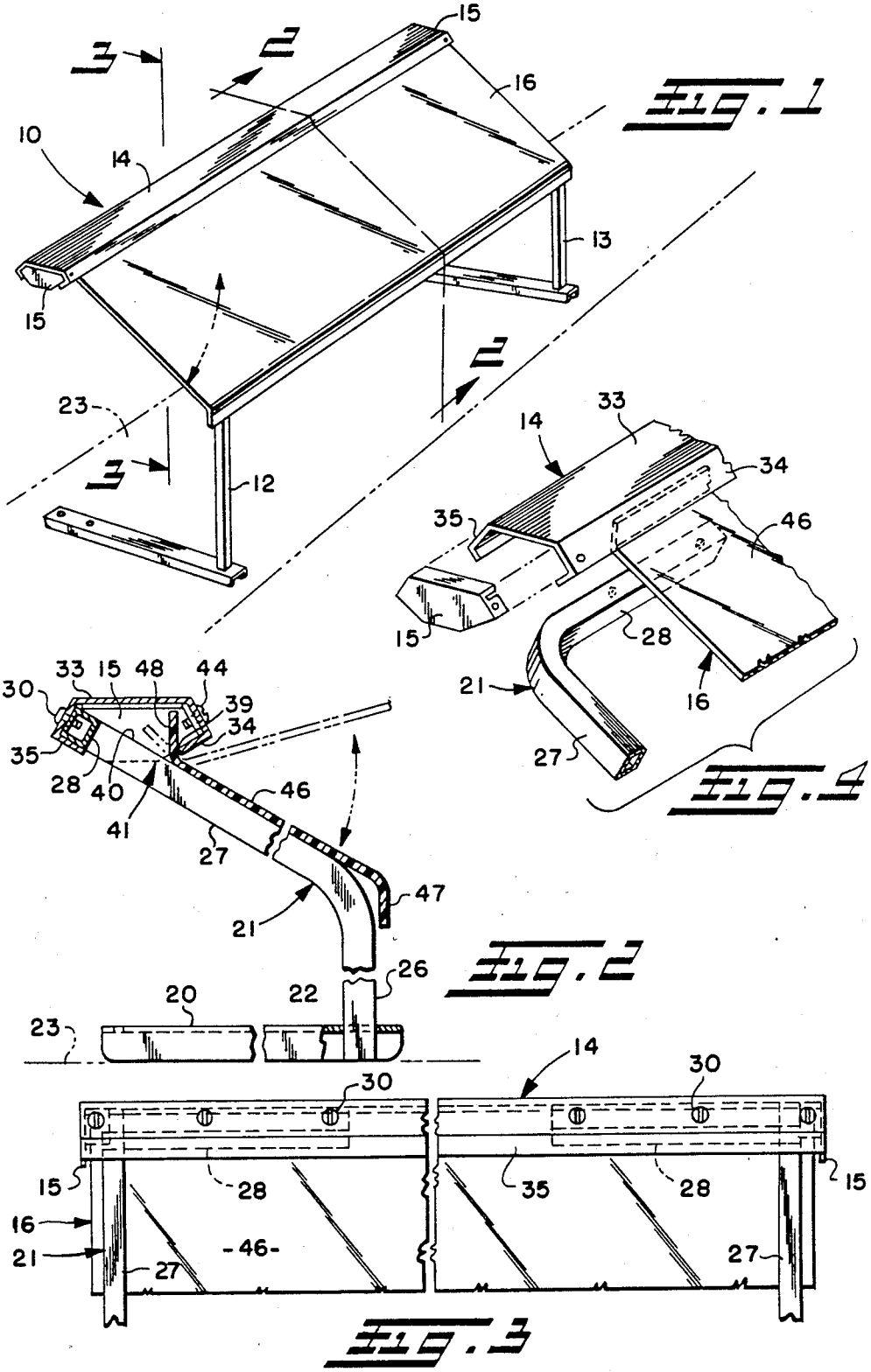
FIG. 1 is a perspective view of a sneeze guard system according to the invention.
FIG. 2 is a vertical sectional view through the sneeze guard system of FIG. 1 taken substantially along the line 2—2 thereof.
FIG. 3 is a fragmentary rear elevational view of the sneeze guard system of FIG. 1 as viewed generally in the direction of the arrows 3—3 thereof.
FIG. 4 is an exploded, fragmentary perspective view of an upper rear corner portion of the sneeze guard system.

Referring now in detail to the drawing and initially to FIG. 1, a preferred form and type of sneeze guard system according to the invention is designated generally by reference numeral 10. The sneeze guard system 10 generally comprises a pair of leg assemblies or stands 12 and 13, a top channel member 14, a pair of channel end caps 15 and a sneeze guard panel 16. Although the illustrated system 10 is of a free-standing type, it will be appreciated that principles of the invention may be employed in other types of sneeze guard systems and take various forms. Preferably, the leg assemblies, top channel member and end caps are chrome plated or stainless steel for appearance and sanitary purposes.

With additional reference to FIGS. 2–4, each leg assembly 12,13 is of a fabricated construction including a base member 20 and an upright tubular leg 21 secured at its bottom end to the front end of the respective base member. Each base member 20 is an inverted U-shape, straight channel piece having a socket opening 22 in the top web portion thereof into which the bottom end of the respective leg 21 may be inserted for welding to the inner side surfaces of the channel piece. In the assembled system, the base member of each leg assembly 12, 13 is parallel and at a common elevation to the base member of the other leg assembly for flat support atop a horizontal surface indicated in phantom lines at 23 in FIGS. 1 and 2, which surface may be a table top or counter top, for example.

The upright leg 21 of each leg assembly 12,13 is gradually bent or curved intermediate its length in like manner to the leg of the other leg assembly to define a straight lower leg portion 26 that extends vertically from the base member 20 and a straight intermediate leg portion 27 that extends both vertically upwardly and rearwardly at an incline and in a vertical plane common to the base member. At the upper rear end of the intermediate leg portion 27, the leg 21 is more sharply bent to define an upper leg portion 28 extending inwardly and perpendicular to the intermediate leg portion, and thus horizontally when the base members 20 of the system are supported on the horizontal surface 23. Except for the resulting opposite extension directions of the upper leg portions 28, the leg assemblies are identical as is preferred for manufacturing and appearance purposes.

The upper leg portions 28 of the leg assemblies 12 and 13 are received in respective ends of the channel member 14 and secured thereto by fasteners such as sheet metal screws 30. Consequently, the channel member 14 extends horizontally between the leg assemblies 12 and 13 which, by such securement to the channel member, are held upright in horizontally spaced relationship.

As best seen in FIG. 2, the channel member 14 has an inverted generally U-shape cross-section. When the channel member is secured between and to the leg assemblies 12 and 13 as shown, the flat top wall or web 33 of the channel member preferably resides in a horizontal plane (parallel to the common plane of the base members 20). Depending from the front and rear edges of the top wall are front and rear flanges 34 and 35, respectively. Each flange 34, 35 is bent downwardly first outwardly and then inwardly to give them a right angle V-shape in cross-section with the open ends of the V's formed by the flanges opposed and aligned in front to rear opposition along the length of the channel member. As illustrated in FIG. 2, the upper portion 28 of each leg 21 is of square tubular cross-section and nests in the correspondingly sized bight of the V formed by the rear flange 35 for secure fixing of the channel member to the legs by the screws 30.

The bottom edge 39 of the front flange 34 of the channel member 14 is spaced apart from the inclined plane of the top surfaces 40 of the intermediate leg portions 27 to define narrow horizontally extending slots 41 at the areas of such front flange overlying the respective intermediate leg portions. The purpose of the thusly formed slots 41 is hereinafter discussed.

The leg assemblies 12 and 13 are positioned inwardly from the ends of the channel member 14 to provide the aforementioned overlay as well as to accommodate the respective end caps 15 received in respective ends of the channel member. The end caps have a configuration corresponding to the interior shape of the channel member for telescopic insertion into the channel member and securement by fasteners such as sheet metal screws 44.

Referring now to the sneeze guard panel 16, such preferably is in the form of a clear plastic or glass panel having a length substantially corresponding to the length of the channel member 14. The sneeze guard panel is generally rectangular in shape having a major planar central portion 46, a gradually downturned bottom edge portion 47 and a gradually upturned top edge portion 48. The bottom and top edge portions 47 and 48 preferably are parallel and otherwise identical except for their opposite extension from the central portion 46. Accordingly, the sneeze guard panel could be flipped over whereupon the bottom edge portion would become the top edge portion and the top edge portion the bottom edge portion.

As seen in FIG. 2, the thickness of the sneeze guard panel 16 is smaller than the gap size of the slots 41 formed between the front channel flange 34 and the top surfaces 40 of the respective intermediate leg portions 27. Accordingly, the top edge portion 48 of the sneeze guard panel may be inserted through the slots 41 upon manipulating the sneeze guard panel to bring the top edge portion generally parallel to and atop the intermediate leg portions 27. After the top edge portion 48 has been inserted through the slots 41 to position the bend or curve between the top edge portion and the planar central portion 46 of the sneeze guard panel within the slots, the sneeze guard panel can then be pivoted downwardly to bring the central portion 46 thereof to rest atop the inclined top surfaces 40 of the intermediate leg portions 27 as shown in solid lines in FIG. 2. When the central portion 46 comes to rest atop the intermediate leg portions in a supported position, the top edge portion 48, having rotated in the interior of the channel member, will be substantially upright and interfere with the front channel flange 34 to hold the sneeze guard panel in place. In this manner, the channel member serves as a mount for the sneeze guard panel.

Removal of the sneeze guard panel 16 can just as easily be accomplished by pivoting the sneeze guard panel upwardly from its supported position to its phantom line release position seen in FIG. 2 bringing the top edge portion 48 once again into generally parallel relationship to the intermediate leg portions whereupon the top edge portion can be withdrawn through the slots 41.

In view of the foregoing, the angle of the bend or curve between the lower and intermediate leg portions 26 and 27 of each leg assembly 12, 13 may be selected to provide a desired incline to horizontal of the central portion 46 of the sneeze guard panel 16. Preferably the included angles between the central portion and the top and bottom edge portions 47 and 48 of the panel are substantially equal the included angle between the intermediate leg portion 27 and lower leg portion 26 of each leg assembly whereby when the sneeze guard panel is supported as shown in solid lines in FIG. 2, the top and bottom edge portions thereof extend substantially vertically.

As further shown in FIG. 2, the inclined height of the central portion 46 of the sneeze guard panel 16 is sized so that the bottom downturned edge portion 47 is positioned slightly in front of the lower leg portions 26, whereupon the bottom edge portion 47 can engage the lower leg portions to limit the amount by which the panel might accidentally be pushed back out of position. Accidental push back also may be restricted by engagement of the top edge portion 48 between the channel top wall 33 and the top surfaces 40 of the intermediate leg portions. It also is noted that the height of the lower leg portions 26 may be selected to provide a desired vertical space (food clearance height) between the bottom edge of the sneeze guard panel and the horizontal surface 23 supporting the sneeze guard system. Also, the included angle between the channel top wall 33 and the upper sections of the front and rear flanges 34 and 35 preferably is equal the included angle between the lower and intermediate leg portions 26 and 27 such that when secured as shown in FIG. 2, the channel top wall will reside in a horizontal plane as is desired. However, modifications and adaptations may be made.

It can now be seen that the invention provides an improved sneeze guard system having a unique mounting arrangement for detachable securement of a sneeze guard panel to a support therefor in both a quick and easy manner without having to install or remove screws, bolts, clips or other hardware items. Detachment of the sneeze guard panel from the support is effected by simply pivoting the sneeze guard panel relative to the support from a supported position to a release position permitting removal of the sneeze guard panel. Mounting of the sneeze guard panel to the support is just as easily accomplished in reverse manner.

Moreover, the sneeze guard system exhibits a stark simplicity of design that will serve to add beauty as well as hygienic protection to a food display. Although illustrated as a self-standing system for support atop a table, counter or the like, the system may be otherwise configured and adapted such as for suspended support from a ceiling, clamping to a table, socket mounting to a table, etc., while still embodying principles of the invention and the associated benefits.

Although the invention has been shown and described with respect to a preferred embodiment, it is obvious that equivalent alterations and modifications will occur to others skilled in the art upon the reading and understanding of this specification. The present invention includes all such equivalent alterations and modifications, and is limited only by the scope of the following claims.

I claim:

1. A sneeze guard system comprising a sneeze guard panel, support means for supporting said sneeze guard panel in a first position, and means for mounting said sneeze guard panel to said support means in such first position while permitting removal of said sneeze guard panel upon pivoting to a second position, said sneeze guard panel having an upwardly turned top edge portion opwerative in such first position of said sneeze guard panel to interfere with said means for mounting to hold said sneeze guard panel on said support means and in such second position to clear said means for mounting to permit removal of said sneeze guard panel.

2. A system as set forth in claim 1, wherein said means for mounting includes channel means defining slot means sized to permit insertion of said top edge portion into said channel means when said sneeze guard panel is in such second position and then pivoting of said top edge portion within said channel means upon pivoting of said sneeze guard panel to such first position.

3. A system as set forth in claim 2, wherein said support means includes a pair of support legs fixedly secured at top ends thereof to said channel means, said support legs having sneeze guard panel support portions atop which respective ends of said sneeze guard panel rest when in such first position.

4. A system as set forth in claim 3, wherein said channel means has front and rear depending flanges, said support legs are secured fixedly to said rear flange, and said support portions of said support legs form with said front flange respective slots of said slot means.

5. A system as set forth in claim 3, further comprising base members respectively secured to the bottom ends of said support legs and extending substantially perpendicular to said channel means.

6. A system as set forth in claim 5, wherein said base members reside in a common plane and said support portions of said support legs reside in a common plane inclined to the common plane of said base members.

7. A system as set forth in claim 3, wherein said channel means has an inverted generally U-shape cross-section.

8. A system as set forth in claim 1, wherein said support means includes a pair of support legs fixedly secured to respective ends of said means for mounting.

9. A system as set forth in claim 8, wherein said support legs have sneeze guard panel support portions and top end portions extending perpendicularly to said support portions for fixed receipt in respective ends of said channel means.

10. A sneeze guard system comprising a sneeze guard panel having a top edge portion inclined to a major portion thereof, a pair of support legs having coplanar panel support portions atop which the major portion of said panel may rest in a supported position, and a channel member secured between the top ends of said support legs and defining therewith slots opening to the interior of said channel member which are sized to permit passage of the top edge portion of said channel when aligned substantially parallel to the support portions of said support legs and then pivoting of the top edge portion of said panel within said channel member to an interfering position precluding withdrawal of the top edge portion through the slots when said panel is in its supported position.

11. A system as set forth in claim 10, wherein said channel means has front and rear depending flanges, said support legs are secured fixedly to said rear flange, and said support portions of said support legs form with said front flange respective ones of said slots.

12. A system as set forth in claim 10, further comprising base members respectively secured to the bottom ends of said support legs and extending substantially perpendicular to said channel member.

13. A system as set forth in claim 11, wherein said base members reside in a common plane and said support portions of said support legs reside in a common plane inclined to the common plane of said base members.

14. A system as set forth in claim 9, wherein said channel member has an inverted generally U-shape cross-section.

* * * * *